US005730070A

United States Patent [19]

Kunkel et al.

[11] Patent Number: 5,730,070

[45] Date of Patent: Mar. 24, 1998

[54] APPARATUS FOR INTRODUCING GAS RECIRCULATION TO CONTROL STEAM TEMPERATURE IN STEAM GENERATION SYSTEMS

[75] Inventors: Robert C. Kunkel, Feeding Hills, Mass.; Thomas J. Dunn, Jr., Newington, Conn.

[73] Assignee: Combustion Engineering, Inc., Windsor, Conn.

[21] Appl. No.: 578,009

[22] Filed: Dec. 22, 1995

[51] Int. Cl.[6] ..... F23C 9/00

[52] U.S. Cl. ..... 110/204; 110/234; 110/254; 110/163; 122/1 A; 122/DIG. 1

[58] Field of Search ..... 110/204, 207, 110/234, 302–304, 254, 162, 163; 122/1 A, 20 B, DIG. 1, DIG. 2, DIG. 7

[56] References Cited

U.S. PATENT DOCUMENTS 2,932,288 4/1960 Harman et al. ..... 110/302 X
4,739,713 4/1988 Vier et al. ..... 110/204 X

FOREIGN PATENT DOCUMENTS 663-957 5/1979 U.S.S.R. ..... 122/1 A

*Primary Examiner*—Henry A. Bennett
*Assistant Examiner*—Susanne C. Tinker
*Attorney, Agent, or Firm*—Robert S. Smith

[57] ABSTRACT

An apparatus for introducing gas recirculation into a furnace to control steam temperature includes a hot air chamber for receiving hot air from an air preheater. The hot air chamber has at least one outlet communicating with the interior of the furnace. The apparatus includes a recirculation gas chamber for receiving recirculation gas from a recirculation fan and includes at least one outlet communicating with the interior of the furnace. Each of the chambers is disposed about at least a portion of the circumference of the furnace with one of the chambers disposed above at least a portion of the other. Ducts are provided between the hot air chamber and the air preheater and between the recirculation gas chamber and the recirculation fan to provide communication between the elements. A passageway is disposed between the hot air chamber and the recirculation gas chamber. The apparatus includes a valve movable between a first position wherein flow through the duct from the recirculation fan is blocked and flow through the passageway is open and a second position wherein flow through the passageway is blocked and flow through the duct from the recirculation fan in open.

20 Claims, 5 Drawing Sheets

APPARATUS FOR INTRODUCING GAS RECIRCULATION TO CONTROL STEAM TEMPERATURE IN STEAM GENERATION SYSTEMS

TECHNICAL FIELD

The invention relates to furnaces such as those used in power generation apparatus and more particularly to apparatus for introducing gas recirculation in a furnace. The control of steam temperature is of great importance for many applications. For example, maintaining steam turbine efficiency over a wide load range and avoiding fluctuations in turbine metal temperatures require constant primary steam and reheat temperatures over the anticipated operating load range. To satisfy this requirement, a boiler must be equipped with means for controlling and maintaining such steam temperatures over the desired range. If uncontrolled, steam temperatures will rise as the steam output increases.

One approach to steam temperature control is gas recirculation, in which a portion of the combustion gases are brought back to the furnace and are added to the "once-through" flow of gas passing over the superheater and the reheater. The prior art recirculation approach is to introduce the recirculated gases through a gas recirculation fan located near the coutant of the furnace, into ducts extending the full width of the furnace. These prior art ducts are exposed to radiant heat and accordingly, must be lined with a refractory material. Toggle joints must also be used in this duct system to allow for the downward expansion of the furnace.

Gas recirculation is commonly used in oil fired furnaces as well as combination furnaces that may be fired by either oil or coal. When the combination units are firing coal the gas recirculation system is not used. Prior art systems have used double dampers and seal air to create a positive gas seal for the recirculation fan. More specifically, the conventional apparatus prevents fluid flow from the coutant back through the recirculation duct and recirculation fan by means of dampers and seal air. The double dampers are two separate dampers in axially spaced portions of the same duct. When the dampers are closed to prevent fluid flow, air is forced into the duct intermediate the respective dampers to purge any leakage from the upstream damper. Any leakage is vented into the interior of the furnace.

The prior art also includes apparatus that has injected recirculation air through the windbox mixed with combustion air. Other prior art structures injected recirculation air intermediate compartments for injecting fuel and air mixtures. These approaches have been primarily for reduction of nitrogen oxides (NOx).

OBJECTS AND SUMMARY OF THE INVENTION

It is an object of the present invention to provide apparatus which will be simple in construction and which facilitate steam temperature control.

Another object of the invention is to provide apparatus that will be less expensive than structures that introduce recirculated gas through the furnace bottom.

It is another object of the invention to provide apparatus that will result in a lower power consumption alternative to conventional structures that mix recirculated gas with combustion gas and direct the combination to the windbox.

It has now been found that these and other objects of the invention may be attained in apparatus that is added to existing furnaces or made a part of new furnaces. The apparatus includes a hot air chamber for receiving hot air from an associated air preheater. The hot air chamber has one or more outlets communicating with the interior of the furnace. The apparatus includes a recirculation gas chamber for receiving recirculation gas from a recirculation fan. The recirculation gas chamber includes one or more outlets communicating with the interior of the associated furnace and each of the chambers is disposed about at least a portion of the circumference of the associated furnace and at least a portion of one of the chambers is disposed above at least a portion of the other chamber. The apparatus also includes a duct from the associated air preheater communicating with the hot air chamber and a duct from the associated recirculation fan communicating with the recirculation gas chamber. A passageway is disposed between the hot air chamber and the recirculation gas chamber; and the apparatus includes a valve movable between a first position wherein flow through the duct from the associated recirculation fan is blocked and flow through the passageway between the hot air chamber and the recirculation gas chamber is open to allow flow therebetween and a second position wherein flow through the duct from the associated recirculation and is not blocked and flow through the passageway between the hot air chamber and the recirculation gas chamber is closed to prevent flow therebetween.

In some forms of the invention the gas recirculation chamber and the hot air chamber are disposed in abutting relationship and have a common wall. The passageway is an opening in the common wall in some forms of the invention. The valve may be a flap valve which may include only a single generally rectangular flapper.

In some forms of the invention the flapper is hinged about a rectilinear side thereof and the flapper, the passageway, and the duct from the associated recirculation fan are dimensioned and configured so that the flapper is disposed in blocking relationship to the duct from the associated recirculation fan in the first position, and the flapper is disposed in blocking relationship to the passageway in the first position.

The recirculation gas chamber and the hot air gas chamber may have substantially identical cross-sections taken through horizontal planes. The hot air chamber and the recirculation gas chamber may be aligned such that substantially all of one of the chambers is disposed directly above all of the other of the chambers. At least some of the outlets of the hot air chamber may have dampers disposed therein to regulate the flow of hot air out of the outlets.

At least some of the outlets of the recirculation gas chamber have dampers therein to regulate the flow of recirculation gas out of the outlets. In some forms of the invention each of the chambers extends across one wall of the associated furnace as well as the two corners thereof that are adjacent to the one wall whereby both hot air and recirculation gas may be directed tangentially to the interior of the associated furnace. The hot air chamber may be disposed at a higher elevation than the recirculation gas chamber,

BRIEF DESCRIPTION OF THE DRAWING

The invention will be better understood by reference to the accompanying drawing in which.

DESCRIPTION OF THE PREFERRED EMBODIMENT

Figure 1:
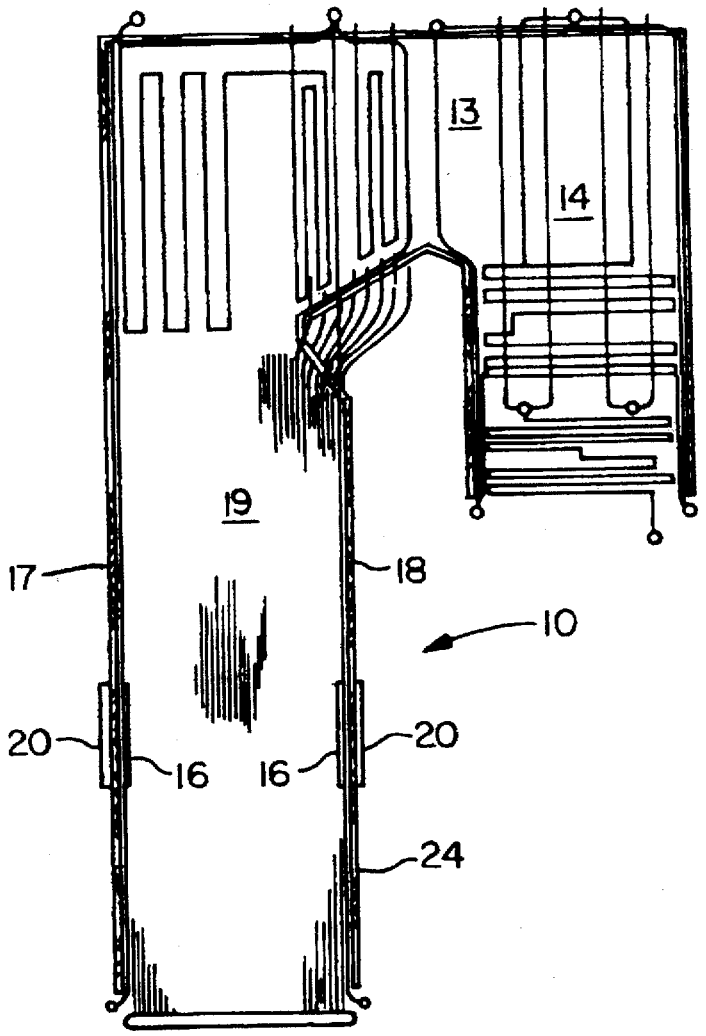
FIG. 1 is a side elevational view of a furnace that may utilize the present invention.
Figure 2:
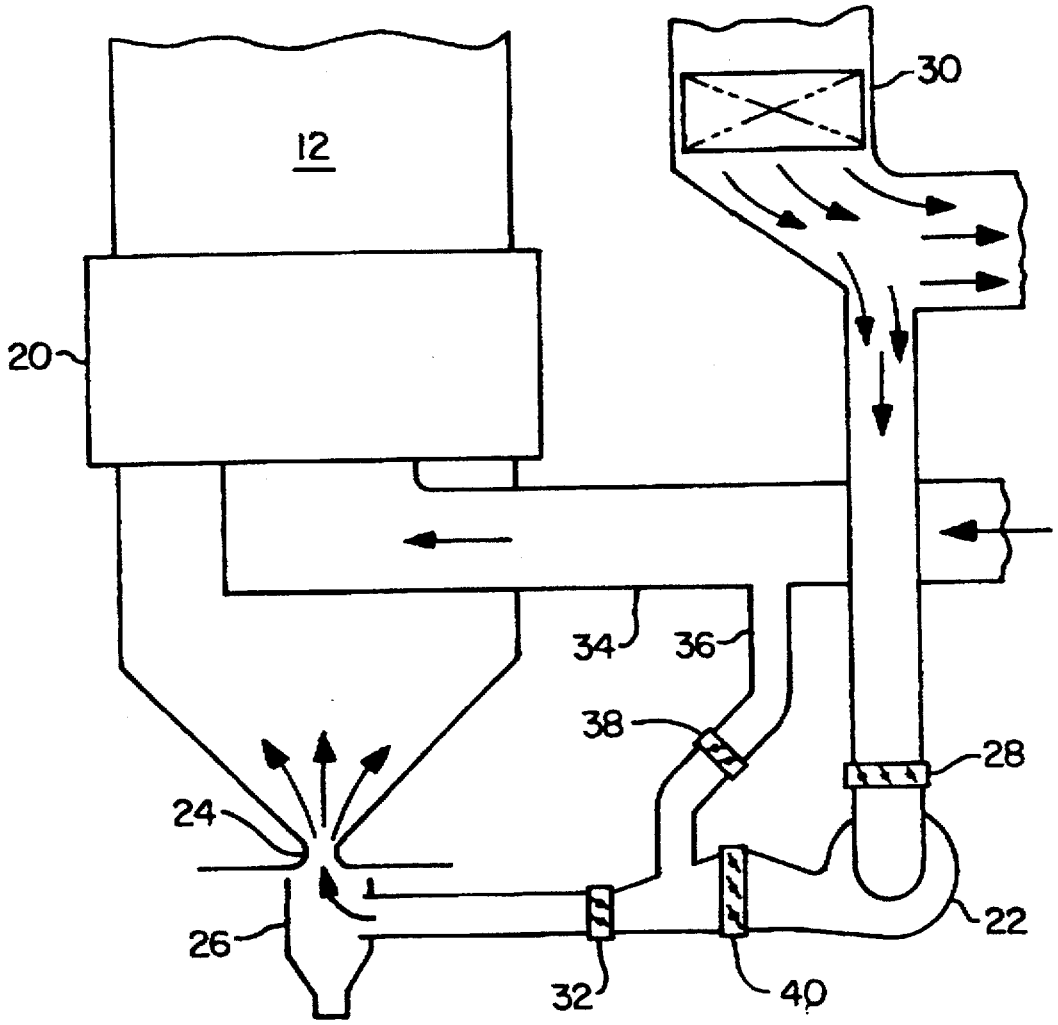
Fig. 2 (PRIOR ART)
FIG. 2 is a schematic elevational view illustrating in greater detail a conventional gas recirculation system.
Figure 3:
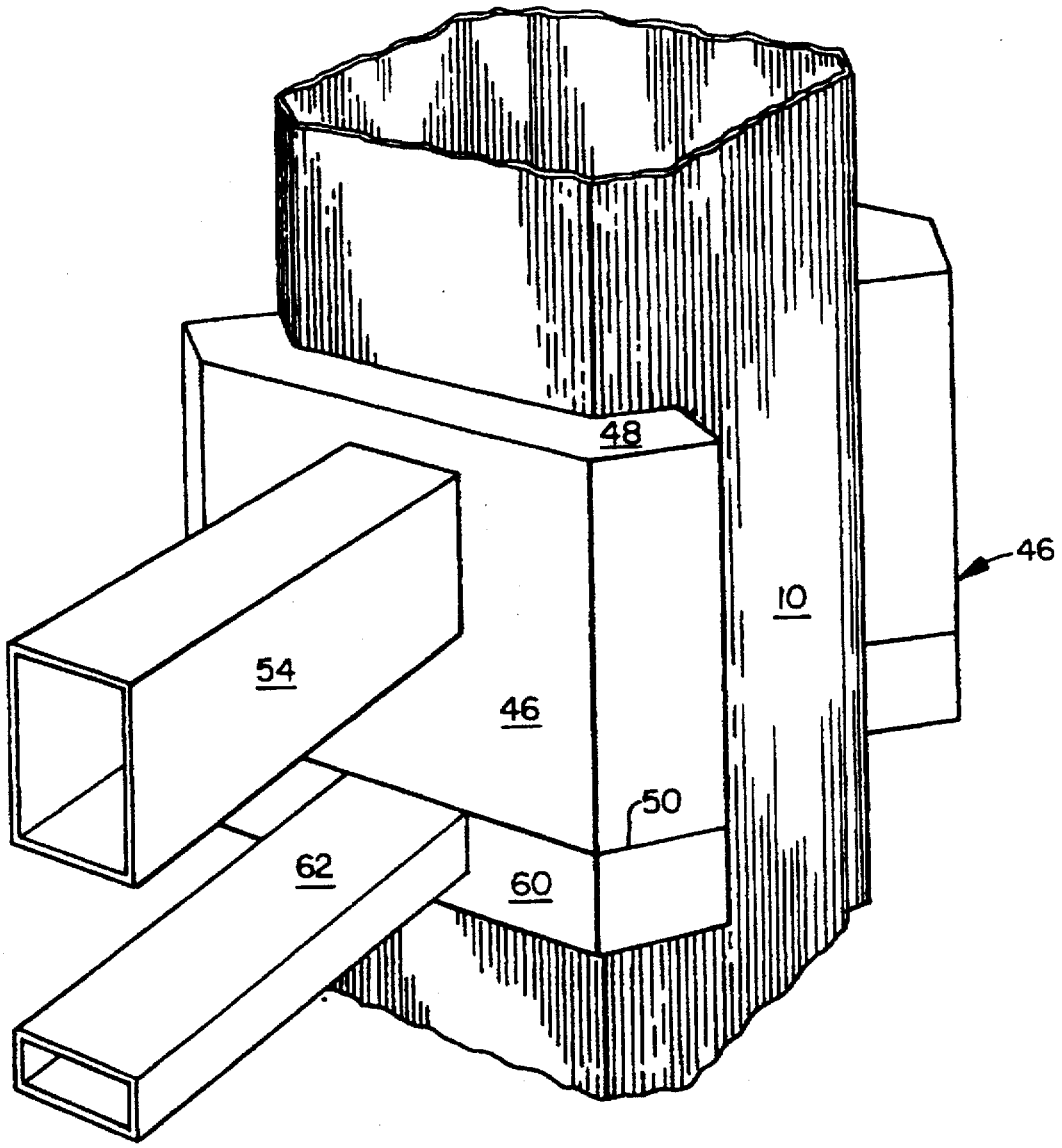
FIG. 3 is a perspective view of a portion the windbox elevation of a furnace which incorporates the present invention and which illustrates the position of the dampers when to no gas recirculation is being used.
Figure 4:
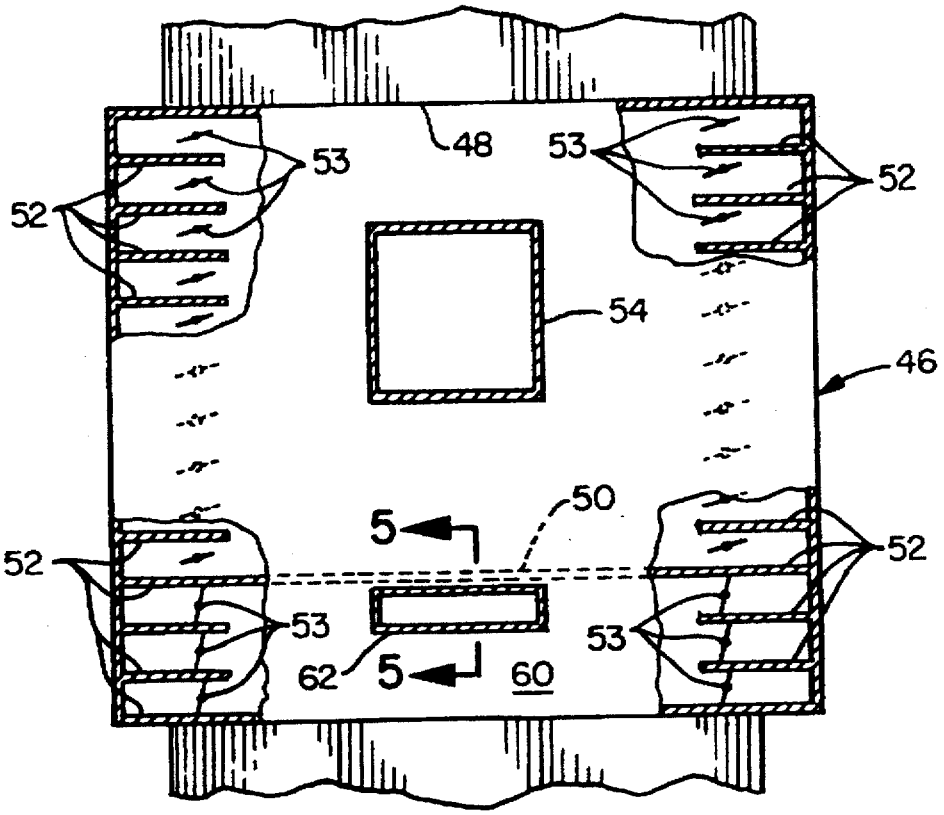
FIG. 4 is a schematic front elevational view of the windbox showing the flap door blocking the gas recirculation duct and allowing passage of hot air from the hot air plenum into the gas recirculation plenum.

Referring now to FIGS. 1 and 2 there is shown a conventional furnace 10, including a waterwall 12. It will be understood the present invention may be incorporated in a wide variety of furnace structures and that the illustrated furnace 10 is only one such furnace. The furnace 10 is vertically disposed and has an outlet for combustion gases at its upper end extending from the rear wall thereof. Extending from this outlet is a lateral gas pass 13 which connects with the upper end of a vertically extended gas pass 14 that extends downwardly in parallel relation with the furnace 10. Combustion gases sequentially pass through the furnace 10, the lateral gas pass 13, a gas pass 14 and a stack (not shown). The illustrated furnace 10 is provided with burners 16 and windboxes 20. The furnace is made up of a front wall 17 and rear wall 18. Side walls 19 (one shown) are disposed in spaced relationship and join the front wall 17 and the rear wall 18. Each of the walls 17, 18, 19 is a waterwall having a plurality of tubular members extending vertically.

Referring now to FIG. 2 there is shown the prior art approach. In this approach the recirculated gas is introduced through a gas recirculation fan 22 located near the coutant 24 of the furnace, into ducts 26 extending the full width of the furnace. This requires that "A-frame" supports at the bottom of the furnace bottom be designed to permit entrance into the furnace through offset tube openings in the coutant 24 bottom. These prior art ducts 26 are exposed to radiant heat and accordingly, must be lined with a refractory material. Toggle joints must also be used in this duct system to allow for the downward expansion of the furnace.

The gas supplied to the gas recirculation fan 22 is tapped off the main gas duct after the gas leaves the economizer 30 and before the gas enters the air preheater (not shown. A damper 28 controls the flow and is part of the steam temperature control system. The gas recirculation fan 22 is necessary to overcome the pressure differential between the furnace and the economizer 30 outlet. If for any reason the fan 22 is shut down while the boiler is in operation, high temperature furnace gas would flow backward through the fan 22 and the associated ducts. Because these ducts and the fan are not designed to withstand such temperatures seal air is provided. More particularly, the shutoff damper 32 and the damper 40 disposed at axially spaced parts of the duct downstream of the fan 22 automatically close when the fan 22 stops. Because even the best shutoff damper has some leakage higher pressure seal air is tapped off the duct 34 directing air from the air heater (not shown) to the windboxes 20. This higher pressure air passes through the valve 38 and duct 36 to the axial part of the duct (1) that is downstream of the fan and (2) intermediate the shutoff damper 32 and the damper 40. The valve 38 is ordinarily shut, but opens automatically upon closing of the shutoff damper 32. This allows a small flow of seal air to protect the equipment that might be damaged.

Referring now to FIGS. 3–7 there is shown the apparatus in accordance with one form of the present invention. The apparatus includes a windbox 46 which is a plenum chamber for air from the preheater (not shown). In the preferred embodiment each windbox 46 extends around one side and the two corners that are adjacent to that side of the furnace 10. In other embodiments of the invention the furnace 10 may have a windbox at each corner of the furnace or on one side or on two opposed sides. The term "side" in this context includes the front and back of the furnace. Such embodiments will still incorporate important features of the invention that will now be described.

In the illustrated preferred embodiment the windbox includes a hot air plenum 46 that has a generally planar top 48 and a generally planar bottom or common wall 50. The vertical extent of the windbox hot air plenum 46 that abuts the furnace 10 includes a plurality of parallel spaced plates 52 that define the openings through which the hot air is directed into the interior of the furnace 10. Between each adjacent pair of plates 52 is disposed a pivotally mounted damper 53. A duct 54 is connected substantially to the geometric center of the hot air plenum 46.

A recirculation gas plenum 60 is disposed in the illustrated embodiment in abutting relationship to the hot air plenum 46. More particularly, the recirculation gas plenum 60 and the hot air plenum 46 have the common wall 50. That common wall 50 may also be referred to as the generally planar bottom of the hot air plenum 46. In the preferred embodiment the recirculation gas plenum 60 and the hot air plenum 46 have identical cross sections and both extend across one side and two adjacent corners of the furnace 12. The recirculation gas plenum 60 also includes a plurality of spaced parallel planar plates 52. Pivotally mounted dampers 53 are disposed between adjacent plates 53. A duct 62 couples the recirculation gas plenum 60 to the recirculation fan 22.

Preferably the duct 62 is rectangular in cross section and one side is aligned with and substantially coplanar with the bottom 50 of the hot air plenum 46. The bottom or common wall 50 is preferably provided with an opening 64 that is substantially adjacent to the intersection of the common wall 50 and the duct 62. A flap door 66 is carried on a hinge 65 having a hinge pin that is disposed so as to be substantially coincident at the intersection of the common wall 50 and one side of the duct 62. Stated another way the flap door is generally rectangular and, in the preferred embodiment, is pivotally mounted about one edge thereof disposed near the intersection of the duct 62, the bottom 60 and the recirculation gas plenum 60.

Figure 5:
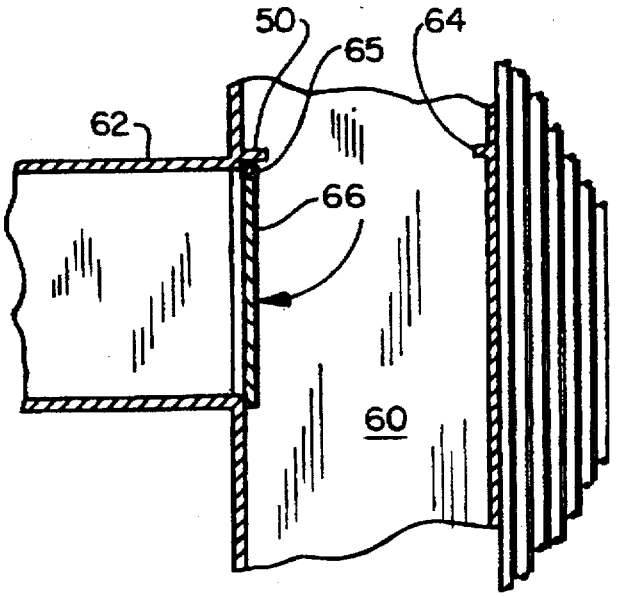
FIG. 5 is a view similar to that of FIG. 3 illustrating the position of the dampers when gas recirculation is being used.
Figure 6:
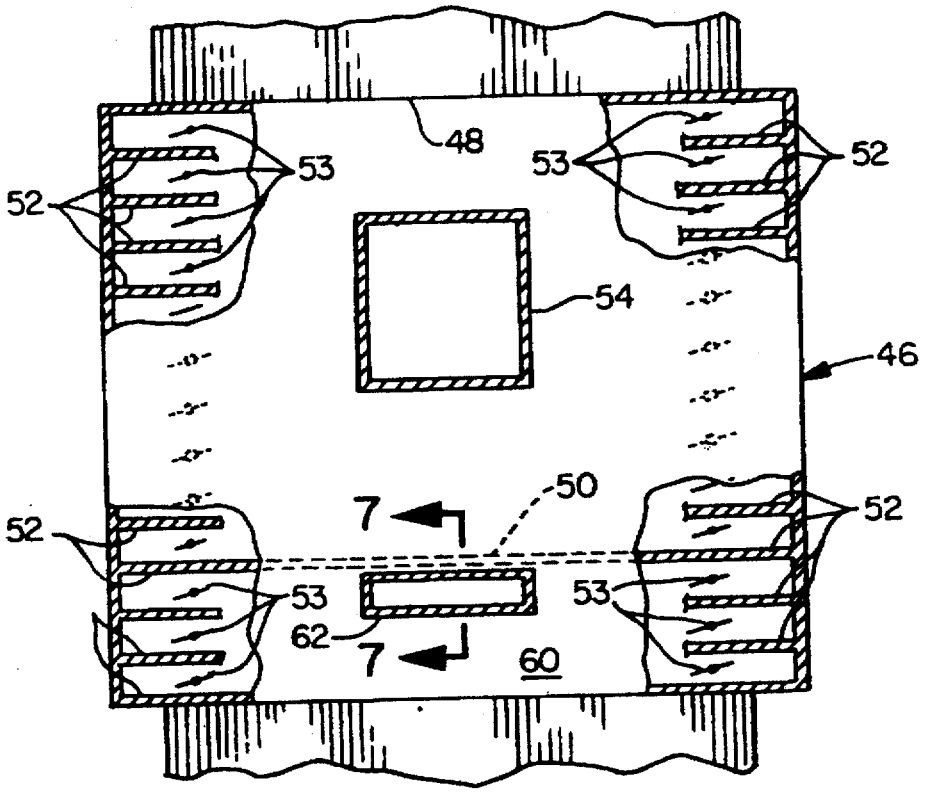
FIG. 6 is a view similar to that of FIG. 4 illustrating the position of the flap door when gas recirculation is being used.
Figure 7:
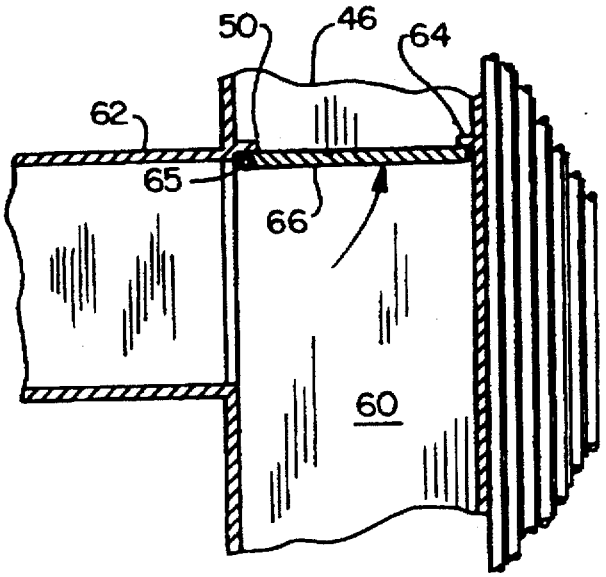

The flap door 66 is movable from the position, shown in FIG. 5, to the position in FIG. 7. In the former position the hot air from the hot air plenum 46 passes through the opening 64 in the common wall 50 and is distributed to the interior of the furnace 10 through openings, in the recirculation plenum 60, defined in part by the plates 52 disposed therein. The dampers 53 in the openings defined by the plates 52 in the recirculation plenum 60 control the flow of the gases into the furnace 10.

In the latter position of the flap door 66, shown in FIG. 7, the flap door 66 is positioned to block the opening 64 in the common wall 50. It is this flap door 66 position that prevents the flow of hot air from the hot air plenum 46 into the recirculation gas plenum 60. In this position recirculation gas flows into the duct 62 and then into the recirculation gas plenum 60. The dampers 53 disposed intermediate the plates 52, within the recirculation gas plenum 60, modulate the amount of recirculation gas that is directed to the interior of the furnace 10. Thus, these dampers 53 in the gas recirculation plenum control steam temperature in the furnace 10.

The preferred embodiment has been shown to have a common wall 50. Those skilled in the art will recognize that the recirculation gas plenum 60 may alternatively be disposed at a higher elevation than the hot air plenum 46 in other forms of the invention. Preferably, the two plenums will still have a common wall because this arrangement is more simple than having two completely separate chambers. The simplicity is desirable because the structure is easier and cheaper to construct. Alternatively, the chambers could be independent chambers connected by a duct (not shown). Preferably, even in such embodiments, the apparatus will also include a flap door 66 that will provide the same redirection of flow that has been described above.

The invention has been described with reference to its illustrated preferred embodiment. Persons skilled in the art of such devices may upon disclosure to the teachings herein, conceive other variations. Such variations are deemed to be encompassed by the disclosure, the invention being delimited only by the following claims.

Having thus described our invention, we claim:

1. Apparatus for cooperation with an associated furnace which comprises:

a hot air chamber for receiving hot air from an associated air preheater, said hot air chamber having at least one outlets communicating with the interior of the associated furnace;

a recirculation gas chamber for receiving recirculation gas from a recirculation fan, said recirculation gas chamber having at least one outlets communicating with the interior of the associated furnace, each of said chambers being disposed about at least a portion of the circumference of the associated furnace, at least a portion of one of said chambers being disposed above at least a portion of the other chamber;

a duct from the associated air preheater communicating with said hot air chamber;

a duct from the associated recirculation fan communicating with said recirculation gas chamber;

a passageway disposed between said hot air chamber and said recirculation gas chamber; and a valve movable between a first position wherein flow through said duct from the associated recirculation fan is blocked and flow through said passageway between said hot air chamber and said recirculation gas chamber is open to allow flow therebetween and a second position wherein flow through said duct from the associated recirculation fan is not blocked and flow through said passageway between said hot air chamber and said recirculation gas chamber is closed to prevent flow therebetween.

2. The apparatus as described in claim 1, wherein: said gas recirculation chamber and said hot air chamber are disposed in abutting relationship and have a common wall.

3. The apparatus as described in claim 2, wherein:

at least some of said outlets of said hot air chamber have dampers disposed therein to regulate the flow of hot air out of said outlets.

4. The apparatus as described in claim 3, wherein:

at least some of said outlets of said recirculation gas chamber have dampers therein to regulate the flow of recirculation gas out of said outlets.

5. The apparatus as described in claim 4, wherein each of said chambers extends across one wall of the associated furnace as well as the two corners thereof that are adjacent to said one wall whereby both hot air and recirculation gas may be tangentially to the interior of the associated furnace.

6. The apparatus as described in claim 4, wherein:

said hot air chamber is disposed at a higher elevation than said recirculation gas chamber.

7. The apparatus as described in claim 2, wherein:

said passageway is an opening in said common wall.

8. The apparatus as described in claim 7, wherein:

said valve is a flap valve.

9. The apparatus as described in claim 8, wherein:

said flap valve has only a single generally rectangular flapper.

10. The apparatus as described in claim 9, wherein:

said flapper is hinged about a rectilinear side thereof.

11. The apparatus as described in claim 10, wherein:

said flapper, said passageway, and said duct from the associated recirculation fan are dimensioned and configured so that said flapper is disposed in blocking relationship to said to duct from the associated recirculation fan in said first position, and said flapper is disposed in blocking relationship to said passageway in said first position.

12. The apparatus as described in claim 11, wherein:

said recirculation gas chamber and said hot air gas chamber have substantially identical cross-sections taken through horizontal planes.

13. The apparatus as described in claim 12, wherein: said hot air chamber and said recirculation gas chamber are aligned such that substantially all of one of said chambers is disposed directly above all of the other of said chambers.

14. Combustion apparatus which comprises:

a furnace apparatus having four walls disposed in generally rectangular relationship as viewed in a horizontal cross section;

a recirculation fan for directing furnace gases exiting said furnace apparatus;

a hot air chamber for receiving hot air from an associated air preheater, said hot air chamber having at least one outlets communicating with the interior of the furnace;

a recirculation gas chamber for receiving recirculation gas from said recirculation fan, said recirculation gas chamber having at least one outlets communicating with the interior of the furnace apparatus, each of said chambers being disposed about at least a portion of the circumference of the furnace, at least a portion of one of said chambers being disposed above at least a portion of the other chamber;

a duct from the air preheater communicating with said hot air chamber;

a duct from the recirculation fan communicating with said recirculation gas chamber;

a passageway disposed between said hot air chamber and said recirculation gas chamber; and a valve movable between a first position wherein flow through said duct from the associated recirculation fan is blocked and flow through said passageway between said hot air chamber and said recirculation gas chamber is open to allow flow therebetween and a second position wherein flow through said duct from the associated recirculation fan is not blocked and flow through said passageway between said hot air chamber and said recirculation gas chamber is closed to prevent flow therebetween.

15. The apparatus as described in claim 14, wherein:

said gas recirculation chamber and said hot air chamber are disposed in abutting relationship and have a common wall.

16. The apparatus as described in claim 15, wherein:

said passageway is an opening in said common wall.

17. The apparatus as described in claim 16, wherein:

said valve is a flap valve.

18. The apparatus as described in claim 17, wherein:

said flap valve has only a single generally rectangular flapper.

19. The apparatus as described in claim 18, wherein:

said flapper is hinged about a rectilinear side thereof.

20. The apparatus as described in claim 19, wherein:

said flapper, said passageway, and said duct from the associated recirculation fan are dimensioned and configured so that said flapper is disposed in blocking relationship to said to duct from the associated recirculation fan in said first position, and said flapper is disposed in blocking relationship to said passageway in said second position.

* * * * *